United States Patent [19]

Wang

[11] Patent Number: 4,855,570

[45] Date of Patent: Aug. 8, 1989

[54] ELECTRIC FLUID HEATING UNIT HAVING RADIAL PTC CERAMIC HEATING ELEMENTS

[76] Inventor: Tim Wang, No. 80, Yung-Feng Road, Tai-Ping Village, Taiwan

[21] Appl. No.: 130,998

[22] Filed: Dec. 9, 1987

[51] Int. Cl.[4] ..... F24H 3/04; H01C 1/014; H05B 3/14; H05B 3/20

[52] U.S. Cl. ..... 219/375; 219/205; 219/307; 219/370; 219/381; 219/505; 219/539; 219/541; 219/542; 219/552; 338/22 R; 338/57; 338/319; 338/329

[58] Field of Search ..... 219/359, 365–372, 219/374–376, 381–382, 307, 504, 505, 520, 530, 540, 532, 536, 537, 538, 539–542, 546, 552, 553, 205–207; 338/57, 58, 279–282, 283, 288, 289, 294, 22 R, 329, 318, 319, 320

[56] References Cited

U.S. PATENT DOCUMENTS 2,429,733 10/1947 Trent ..... 219/374
2,790,889 4/1957 Hynes ..... 219/552 X
3,108,174 10/1963 Hynes ..... 219/552 X
4,162,395 7/1979 Kobayashi et al. ..... 219/375 X
4,585,924 4/1986 Pakula ..... 219/205

FOREIGN PATENT DOCUMENTS 46-8918 3/1971 Japan ..... 219/374

*Primary Examiner*—Anthony Bartis
*Attorney, Agent, or Firm*—Darby & Darby

[57] ABSTRACT

An electric heating unit for heating fluid, such as air in a hair drier, includes two ring—shaped electrodes and a plurality of spaced, plate—like ceramic heating elements having a positive temperature coefficient of resistance (PTC) aligned between the electrodes. The electrodes comprise an inner ring and an outer ring disposed in a nested, concentric, spaced relationship. The PTC ceramic plates are radially arranged in aligned spaced relationship with the opposite ends of each PTC ceramic plate mechanically and electrically connected respectively to the inner and outer rings. The inner and outer rings can be formed as arc—shaped segments separated by gaps prevent damage to the PTC ceramic plates by heat strain, and are provided with slits, grooves, etc., for firmly positioning the PTC ceramic plates.

6 Claims, 5 Drawing Sheets

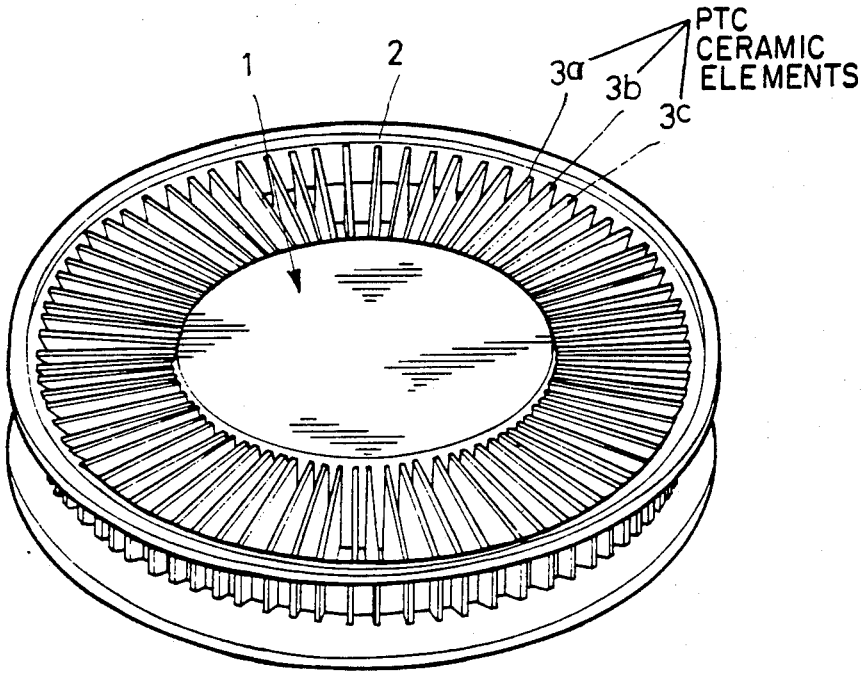
FIG. 1A
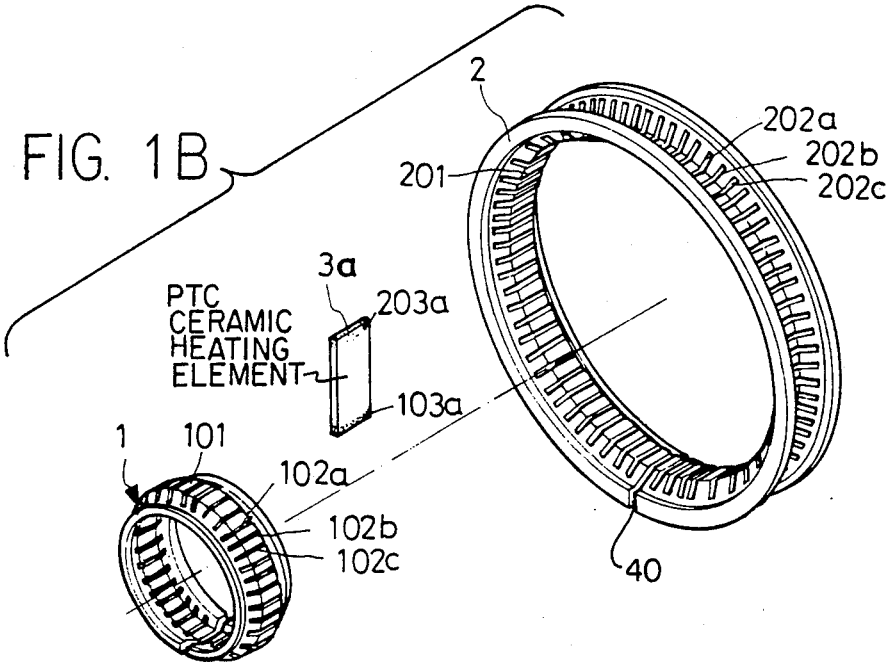

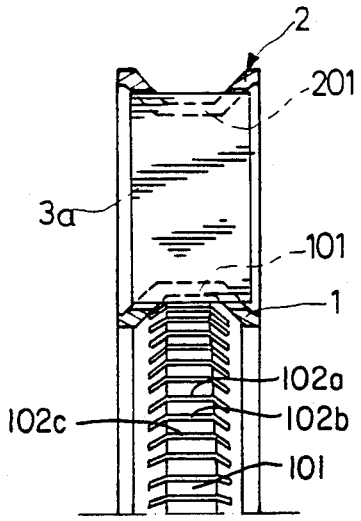
FIG. 2
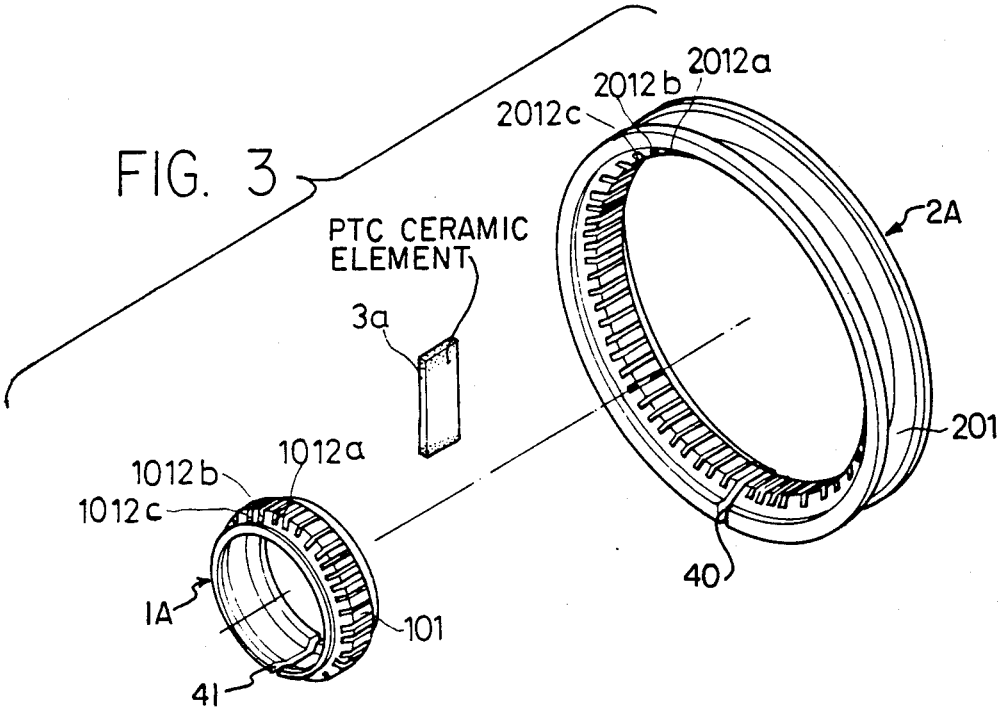

ELECTRIC FLUID HEATING UNIT HAVING RADIAL PTC CERAMIC HEATING ELEMENTS

BACKGROUND OF THE INVENTION

This invention relates to a heating unit for use in a heater or drier, and, more particularly, to a device for heating fluid, in which is incorporated a heating unit having positive temperature coefficient (PTC) ceramic plates for heating fluid passing therethrough.

Such PTC ceramic plates can be employed as a heating means in which electrical energy is converted into thermal energy. When a suitable voltage is applied to a PTC ceramic material, such as s thermistor, the current flowing therethrough is comparatively high initially, so that the PTC ceramic material is heated rapidly up to a predetermined temperature. Thereafter, the current drops to a low value to reduce heat generation from the PTC ceramic, thus maintaining the predetermined temperature.

It is known to use the above described PTC ceramic material in the heaters for a heating unit in which fluid such as air or liquid to be heated passes closely by the PTC ceramic material,thus obtaining heat therefrom.

Referring to FIG. 7, showing a conventional type of heating unit, a plurality of PTC ceramic material heating elements b are aligned in parallel and spaced in relation to each other and are supported by four corner bars C1 to C4. Each PTC ceramic heating element b comprises a PTC ceramic heating body d having a pair of electrodes e1 and e2 provided at opposite end of PTC semiconductor heating body d. Since the corner bars are made of electrically conductive material, the corner bars C1 and C2 electrically connect respective electrodes e1, while the corner bars C3 and C4 electrically connect the other electrodes e2. When a suitable voltage is applied between the electrodes e1 and e2 through the corresponding corner bars, the electrical current flows through the PTC ceramic heating body d both in the inner region and at the outer region of the PTC semiconductor heating body d, thus energizing the PTC semiconductor heating body d to generate heat therefrom. It is apparent that the conventional type of heating unit as shown in FIG. 7 is not suitable for use in heaters or driers widely used nowadays.

SUMMARY OF THE INVENTION

Therefore, it is an object of the present invention to provide an improved type of heating unit employing PTC ceramic heating elements which efficiently produces heat from the surfaces of the PTC ceramic heating body.

It is another object of the present invention to present a heating unit of the type in which the PTC ceramic heating elements are radially disposed and are steadily positioned by ring-shaped electrodes.

It is a further object of the present invention to present a heating unit of the type which efficiently produces heat and rapidly responds to the ambient temperature.

It is still a further object of the present invention to present a heating unit of the type which is simple in construction, and can readily be manufactured.

According to the present invention, the heating unit to be incorporated in the heating device comprises a plurality of PTC ceramic heating elements which are aligned radially and in spaced relation to each other between two ring-shaped electrodes for supporting the heating elements. On the two ring-shaped electrodes, there are correspondingly spaced slits or furrows arranged opposed to each other for holding the ends of each ceramic heating element. Thus, if (1) the two ends of each of the ceramic heating elements are put into a respective pair of opposed slits or furrows formed on the two ring-shaped electrodes, and then (2) the welding material coated on the surfaces of the two ends of the ceramic heating elements is melted, and after that (3) the welding materials are cooled down and solidified, the ceramic heating elements will be positioned very firmly.

A more complete understanding of these and other features and advantages of the present invention will become apparent from a careful consideration of the following detailed description of certain embodiments illustrated in the accompanying drawings.

BRIEF DESCRIPTION OF THE DRAWINGS

FIG. 1A is a perspective view of the preferred embodiment of this invention.

FIG. 1B is an exploded view of the preferred embodiment of this invention as shown in FIG. 1A.

FIG. 2 is a cross-sectional view showing the structure of the preferred embodiment of this invention as shown in FIG. 1A.

FIG. 3 is an exploded view of the second preferred embodiment of this invention.

DETAILED DESCRIPTION OF THE PREFERRED EMBODIMENTS

Referring to FIGS. 1A, 1B and 2, the heating unit of this invention includes an inner ring 1, an outer ring 2, and a plurality of radially spaced and aligned PTC ceramic plates 3*a, b, c.* etc. positioned on the inner ring and the outer ring, wherein, the inner ring 1 and outer ring 2 are made by electric conductive materials, such as copper, silver, gold, etc, and are used as electrodes. As shown in FIGS. 1A, 1B and 2, in the central parts of the inner ring 1 and the outer ring 2, are formed circumferential furrows 101, 201 respectively. When the inner ring 1 is put into the outer ring 2, the furrows 101, 201 are opposite each other. On each of the furrows 101, 201, there are a plurality of slits 102*a, b, c,* etc., 202*a, b, c,* etc. The number of slits on the inner ring and the outer ring are the same, and the spaces between each two slits 102*a, b, c,* etc., or 202*a, b, c,* etc., on the same inner ring or outer ring are the same. Thus, if the inner ring 1 is put into the outer ring 2 concentrically, and each of the PTC ceramic heating plates 3*a, b, c,* etc., with definite length and width is put into each pair of slits 102*a,* 202*a;* 102*b,* 202*b;* etc., respectively, then, the inner ring 1, the outer ring 2 and the PTC ceramic heating plates will form a heating unit. The ends of each ceramic heating plate are coated with welding materials 103*a, b, c,* etc., 203*a, b, c,* etc. Therefore, if the welding materials 103*a, b, c,* 203*a, b, c,* etc., are melted by heating the half-finished products, it will adhere to the walls of the slits 102*a, b, c,* etc., 202*a, b, c,* etc., after the welding materials 103*a, b, c,* etc., 203*a, b, c,* etc., are cooled down and solidified. Then the construction between the rings and ceramic heating plates will be firm. Furthermore, both the inner ring and the outer ring can be split rings with splits 40, 41. In this circumstance, the heat strain caused by the heat transferred from the PTC ceramic heating plates will be released. This will avoid the PTC ceramic plates from slipping off the inner ring 1 and the outer ring 2.

FIG. 3 illustrates the second preferred embodiment of this invention, which is different from the first preferred embodiment shown in FIGS. 1A, 1B and 2. On the outer side of the inner ring 1A and on the inner side of the outer ring 2A, are formed a plurality of concave grooves 1012*a, b, c,* etc.; 2012*a, b, c,* etc. The width of each concave groove is the same as the thickness of the ceramic heating plate. The inner ring is put into the outer ring 2 concentrically and the PTC ceramic heating plates, which are coated with welding materials at its two ends, are put into respective pairs of aligned grooves 1012*a,* 2012*a;* 1012*b,* 2012*b,* etc. Subsequent heating of the half-finished products will melt the welding materials will form a heating unit.

Figure 4:
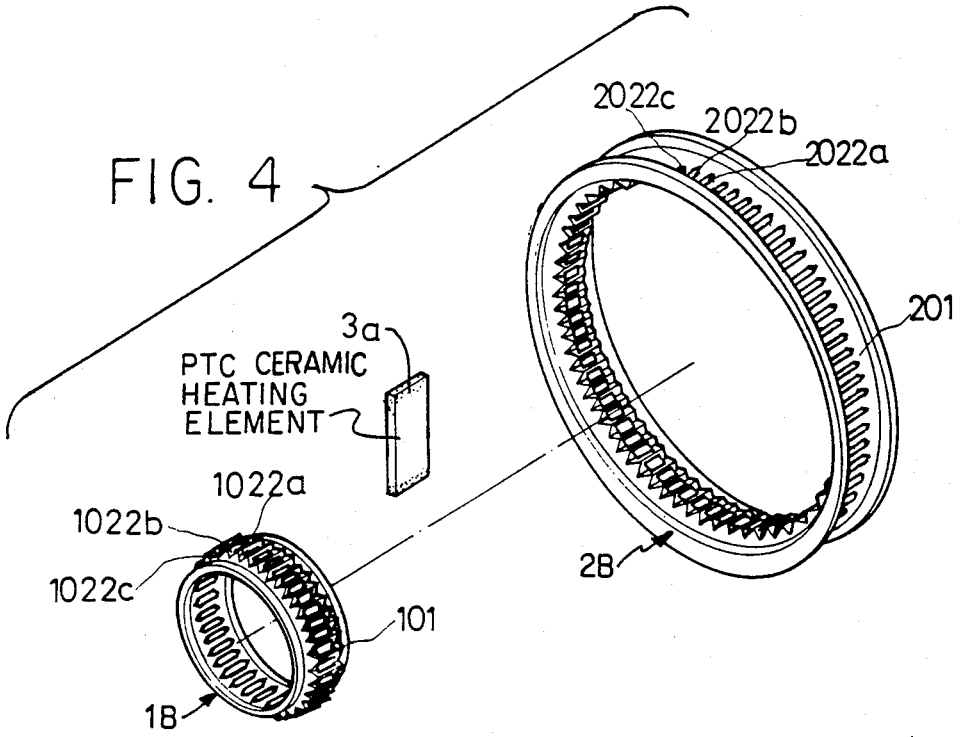
FIG. 4 is an exploded view of the third preferred embodiment of this invention.

FIG. 4 illustrates the third preferred embodiment of this invention, which is different from the first preferred embodiment shown in FIG. 1. There, on the furrow 101, 201 of the inner ring 1B and the outer ring 2B, is formed a plurality of teeth-shaped slit holes 1022*a, b, c,* etc., 2022*a, b, c,* etc. Each of the two opposite aligned slit holes formed on the inner ring 1B and the outer ring 2B, respectively, can be used to hold a PTC ceramic heating plate by utilizing the slope walls of the slit holes. This, the, increases the firmness of PTC ceramic plates.

Figure 5:
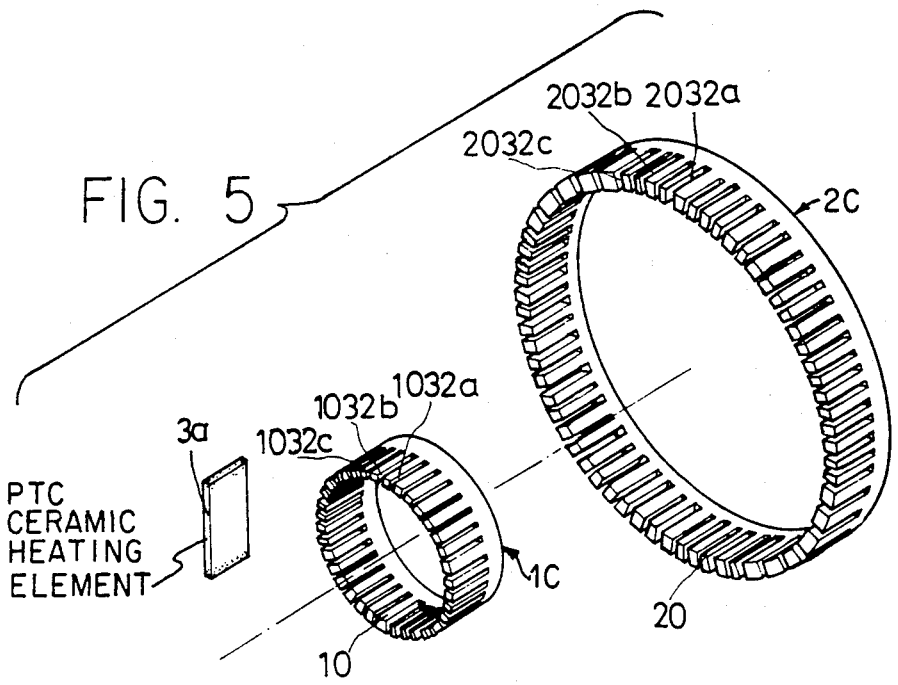
FIG. 5 is an exploded view of the fourth preferred embodiment of this invention.

FIG. 5 illustrates the fourth preferred embodiment of this invention, wherein, the inner ring 1C and the outer ring 2C are round, and a plurality of slits with definite depth and width 1032*a, b, c,* etc., 2032*a, b, c,* etc., are formed, respectively, from one side rim of the inner and outer rings. The two ends of each of the PTC ceramic plates are put in each pair of aligned slits 1032*a, b, c,* etc.; 2032*a, b, c,* etc., from the openings of the slits. After that, the half-finished product is heated to melt the welding material coated onto the ends of the PTC ceramic plates and to let the welding material cool and freeze to a solid. Then, the PTC ceramic heating plates will be held firmly on the inner and outer ring to form a heating unit. The positioning structure of the PTC ceramic heating plates with the inner and outer ring as described above is only an example that the slits on the inner and outer rings are the same in structure. But, the slits can only be formed on one of the rings and the other ring is welded together with one end of the PTC ceramic plates.

Figure 6:
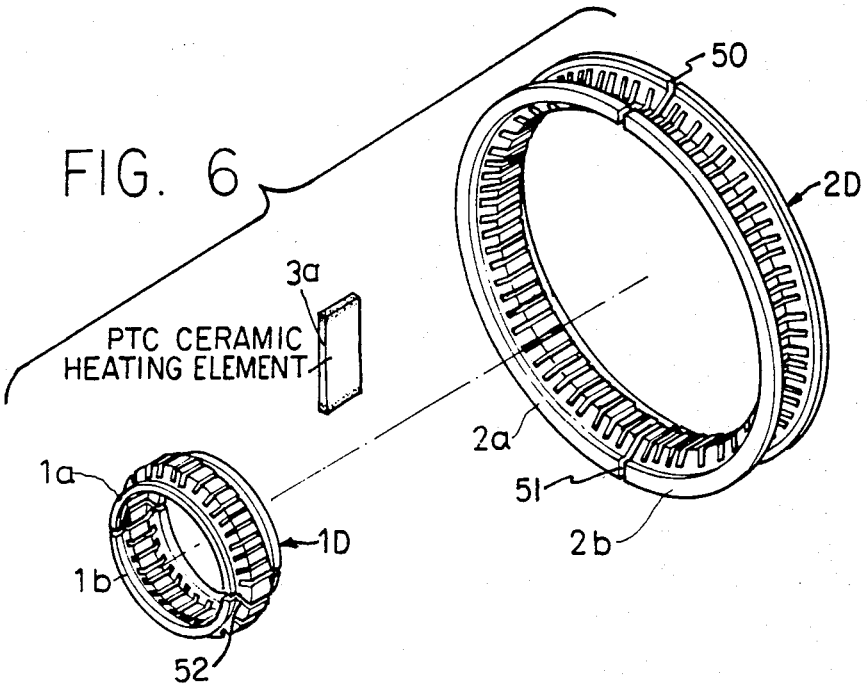
FIG. 6 is an exploded view of another preferred embodiment of this invention showing the structure of inner and outer rings of electrodes.
Figure 7:
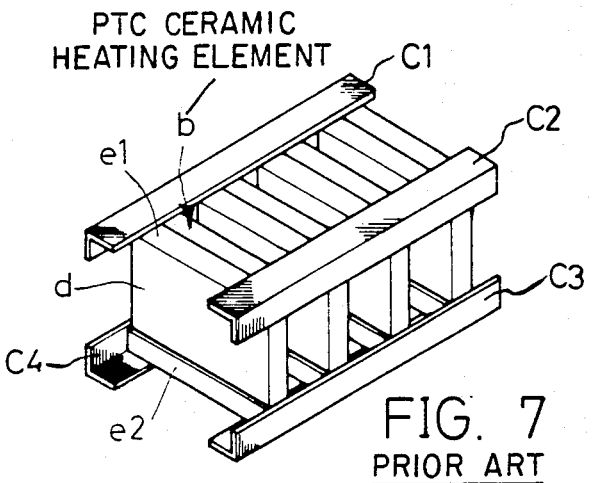
FIG. 7 PRIOR ART
FIG. 7 illustrates prior art fluid heater of the type discussed hereinbefore.

As shown in FIG. 6, the inner ring 1D and the outer ring 2D can be formed by a plurality of arc-shaped sections 1*a,* 1*b,* etc., and 2*a,* 2*b,* etc. Between each two arc-shaped sections of the same ring is a gap, and the gaps 51, 52 of the inner ring 1D and the outer ring 2 are staggered from each other. Thus, the heat strain caused by the heat transferred from the PTC ceramic plates to the rings will be released. This certainly will avoid the PTC ceramic plates from slipping off the rings.

Figure 8:
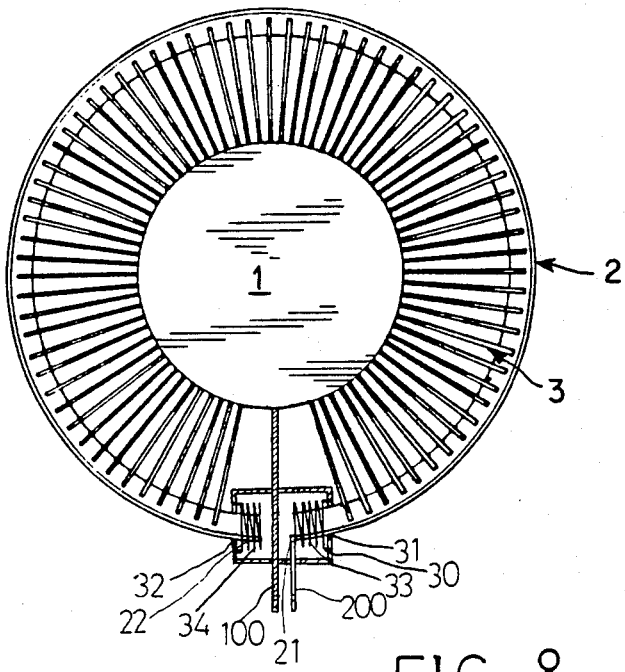
FIG. 8 is a perspective view showing a electric fan employing the heating unit of this invention.

Referring to FIG. 8, in application of the invention, at the gap 21 of the outer ring 2, there is a supporting box 30. On each of the sides of the supporting box 30 is formed a hole 31, 32, respectively, thus enabling the two ends of the outer ring 2 to extend into the supporting box 30. On each of the inner walls of the sides of the supporting box 30, there is a spring 33, 34. The two ends of the outer ring are then fastened to the springs 33, 34 respectively. Furthermore, there is an electrode 200 connected to one end of the outer ring 2; another electrode 100 connected to the inner ring 1 also extends through the supporting box 30 and is supported by it.

Figure 9:
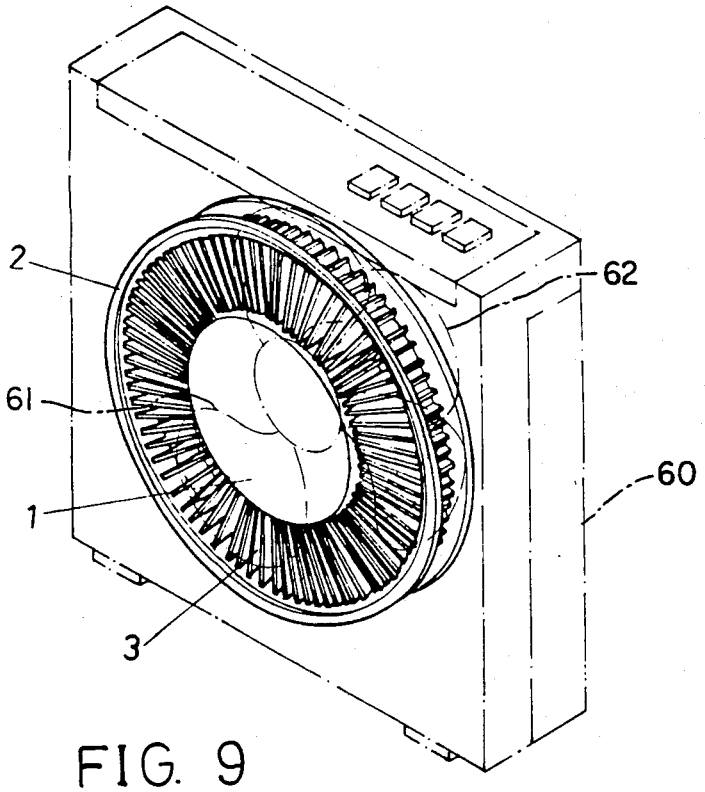
FIG. 9 is a view showing an application of this invention.

As shown in FIG. 9, the heating unit of the present invention is round, and the PTC ceramic heating elements are aligned radially between the inner ring and the outer ring. It is, therefore, very suitable to be employed in electric fans, hair driers, etc. As illustrated, a housing 60 contains a fan 62 driven by a motor 61.

It should be noted that although the heating units of the invention are mainly described for use in heating gas such as air, it is possible to utilize the heating unit of the present invention for employment in a device for heating liquids by completely coating the heating unit with electrical insulating material.

Although the present invention has been fully described by way of examples with reference to the accompanying drawings, it is to be noted that various changes and modification are apparent to those skilled in the art. Therefore, unless such changes and modifications depart from the scope of the present invention, they should be construed as included therein.

What is claimed is:

1. A heating unit for heating fluid comprising: two electrodes and a plurality of spaced, plate-like PTC ceramic heating elements aligned between the two electrodes; said electrodes being ring-shaped and comprising an inner ring and an outer ring, said inner and outer rings being in nested, concentric, spacedrelationship; said PTC ceramic heating elements being in radial, aligned, spacedrelationship with the opposite ends of each PTC ceramic heating element being mechanically and electrically connected respectively to said inner and outer ring-shaped electrodes.

2. A heating unit as claimed in claim 1, wherein said ring-shaped electrodes are made from electrically conductive material and the ends of the PTC ceramic heating elements are metallically, electrically and mechanically bonded to the ring-shaped electrodes.

3. A heating unit as claimed in claim 1, wherein at the central parts of each said electrodes, a circumferential furrow is formed respectively; on each of the furrows, there are a plurality of spaced slits, the number of slits on the inner ring and the outer ring being the same and in radial alignment, the width of the slits being the same as the thickness of PTC ceramic heating elements.

4. A heating unit as claimed in claim 1, wherein on each of the rings is formed at the central parts thereof with a plurality of concave grooves.

5. A heating unit as claimed in claim 1, wherein at central parts of said inner and outer rings are formed circumferential furrows, each having spaced tooth-shaped slit holes.

6. A heating unit as claimed in claim 1, wherein the electrodes are ring-shaped plates, a plurality of spaced slits with definite depth and width for holding the PTC ceramic heating elements are formed from one of the side rims of the ring-shaped plates.

* * * * *